US006851472B2

(12) United States Patent
Hern et al.

(10) Patent No.: US 6,851,472 B2
(45) Date of Patent: Feb. 8, 2005

(54) CONVERTIBLE TUBULAR SCRAPER

(75) Inventors: Gregory Lee Hern, Huffman, TX (US); James Michael McNicol, Aberdeen (GB)

(73) Assignee: Baker Hughes Incorporated, Houston, TX (US)

( * ) Notice: Subject to any disclaimer, the term of this patent is extended or adjusted under 35 U.S.C. 154(b) by 26 days.

(21) Appl. No.: 10/388,196

(22) Filed: Mar. 12, 2003

(65) Prior Publication Data

US 2004/0007355 A1 Jan. 15, 2004

Related U.S. Application Data

(60) Provisional application No. 60/365,051, filed on Mar. 13, 2002.

(51) Int. Cl.[7] ..... E21B 37/02

(52) U.S. Cl. ..... 166/173; 166/311; 15/104.05

(58) Field of Search ..... 166/170, 173, 166/311; 175/291; 15/104.5, 104.09, 104.16, 104.05

(56) References Cited

U.S. PATENT DOCUMENTS

| | | | | | |
|---|---|---|---|---|---|
| 2,072,320 | A | | 3/1937 | Thomas | |
| 2,090,822 | A | | 8/1937 | Wright | |
| 2,589,534 | A | | 3/1952 | Buttolph | |
| 2,665,887 | A | * | 1/1954 | Shelton | 175/295 |
| 2,693,239 | A | * | 11/1954 | Vincent | 166/173 |
| 2,869,827 | A | | 1/1959 | Cook | |
| 3,075,590 | A | | 1/1963 | Cook | |
| 3,364,998 | A | | 1/1968 | Sable | |
| 4,189,000 | A | * | 2/1980 | Best | 166/173 |
| 4,558,738 | A | * | 12/1985 | Howard, Sr. | 166/173 |
| 4,606,417 | A | | 8/1986 | Webb et al. | |
| 4,798,246 | A | * | 1/1989 | Best | 166/311 |
| 6,152,220 | A | | 11/2000 | Carmichael et al. | |
| 6,227,291 | B1 | | 5/2001 | Carmichael et al. | |
| 6,464,010 | B1 | * | 10/2002 | Brown | 166/311 |
| 2001/0022223 | A1 | | 9/2001 | Howlett | |
| 2002/0005284 | A1 | | 1/2002 | Allen | |

OTHER PUBLICATIONS

Baker Oil Tools, Fishing Services Technical Unit; Models "C–3" And "C–1" Roto–Vert Casing Scrapers; Jan. 15, 2002; 7 pages; Unit 4843, Index 500; Baker Hughes Incorporated; U.S.

Baker Oil Tools, Fishing Services Technical Unit; 360° "Clean Bore" Casing Scraper; Feb. 2, 2001; 7 pages; Unit 4560, Index 500, Baker Hughes Incorporated; U.S.

Smith; Non–Rotating Sleeve–Type Stabilizer; Drilco'84–'85 Composite Catalog; date unknown; pp. 287–289; Smith International, Inc.; U.S.

Tri–State Oil Tools; Sleeve Stabilizer; 1995 General Catalog; Apr. 17, 2001; 7 pages, Baker Hughes Incorporated; U.S.

* cited by examiner

*Primary Examiner*—David Bagnell
*Assistant Examiner*—Daniel P Stephenson
(74) *Attorney, Agent, or Firm*—Gerald W. Spinks

(57) ABSTRACT

A tubular scraper which can be assembled so that the blades will be either rotating or non-rotating, as desired. If the tubular scraper is assembled in the non-rotating configuration, and the blades becomes stuck in the casing, the drill string can be pulled upward to engage a clutch. Once the clutch is engaged, the scraper is converted to a rotating scraper, so that the drill string can be rotated to assist in dislodging the stuck scraper blades.

7 Claims, 3 Drawing Sheets

CONVERTIBLE TUBULAR SCRAPER

CROSS REFERENCE TO RELATED APPLICATIONS

This application claims the benefit of U.S. Prov. App. No. 60/365,051; Filed on Mar. 13, 2002, Titled: CONVERTIBLE CASING SCRAPER.

STATEMENT REGARDING FEDERALLY SPONSORED RESEARCH OR DEVELOPMENT

Not Applicable

BACKGROUND OF THE INVENTION

1. Field of the Invention

This invention is in the field of scraping devices used to remove debris from the inner surface of oil field tubulars, such as a casing in an oil well; specifically, this invention is in the field of devices which can remove such debris without rotating the scraping elements relative to the casing, commonly called non-rotating scrapers.

2. Background Art

Casing scrapers have been used for many years to remove scale, perforations, mud cake, cement, or other forms of debris from the internal surface of casing in an oil well. It is particularly important to clean the casing where completion equipment is to be installed. Several companies have provided rotating casing scrapers for many years. Most of these scrapers utilize scraper blades that are pushed against the wall of the casing by compression springs. On most of these scrapers the blades are held in place by a threaded retainer or captured by retaining bolts. If the fasteners vibrate loose or the retainer unthreads, the scraper blades can be left in the oil well. This creates an expensive fishing job to recover the lost blades.

In most applications, the casing scraper is run in the well and possibly rotated for only a short period of time. However, if the wellbore fluid needs to be changed, it may be necessary to rotate the drill string for a long period of time, such as 2 or more hours, during changing of fluid. This is because the ability to rotate the drill string provides the operator with a quicker method to change the wellbore fluid. Since the scraper blades are pushed against the ID of the casing by springs, if the blades are rotated for a long period of time, the casing ID may become worn. So, if a rotating scraper is used, it can be impossible to rotate the drill string for a long period of time while changing the fluid, without damaging the internal surface of the casing. Operators in the North Sea often use a non-rotating casing scraper, because of this problem.

One known non-rotating scraper consists of a non-rotating cylinder that has a larger diameter than the ID of the casing. The cylinder has long axial slits that allow the cylinder to be compressed to fit into the casing. The cylinder can be fitted with blade or brush elements to clean the wall of the casing, as the cylinder is moved through the casing. This type of scraper is very expensive to manufacture and service.

A common disadvantage of non-rotating scrapers is that, if one becomes stuck in a well, it can be difficult to recover. The ability to convert a scraper from non-rotating to rotating could eliminate this disadvantage.

BRIEF SUMMARY OF THE INVENTION

The present invention provides a casing scraper that can be assembled so that the blades will be either rotating or non-rotating, depending upon how the tool is assembled. An additional feature of the invention is that if the casing scraper is assembled in the non-rotating configuration, and the blades become stuck in the casing, the drill string can be pulled upward to shear a shear ring loose, allowing a clutch to engage. Once the clutch is engaged, the scraper is converted to a rotating scraper, so that the drill string can be rotated to assist in dislodging the stuck scraper blades.

The scraper of the present invention does not utilize threads or threaded fasteners to retain the scraper blades. The blades fit into a pocket on a scraper blade sleeve, where they are retained by a T-shaped retaining plate. The T-shaped plate is trapped by a retaining ring, which is held in place by hardened dowel pins. Once the scraper blade sleeve is installed onto the mandrel of the tool, the dowel pins are trapped. The afforementioned assembly process makes it impossible for the scraper blades, or threaded fasteners, to be left in the oil well.

An optional feature of the scraper of the present invention is the non-rotating cylinder brush which can be installed in addition to the blades.

Stabilizers are not necessary in the tool of the present invention to keep the tool centered in the casing. The scraper includes nested compression springs that provide significant force to push the blades against the inner surface of the casing. Spacers can be installed below the scraper blades to limit blade travel in lighter weight casing. Since the extent to which the blades can be pushed back into the blade sleeve is limited by the springs, the blades keep the scraper centered in the casing. This ensures that the blades on the "high side" of the scraper in a slanted or horizontal casing will be able to adequately clean the casing.

The novel features of this invention, as well as the invention itself, will be best understood from the attached drawings, taken along with the following description, in which similar reference characters refer to similar parts, and in which:

DETAILED DESCRIPTION OF THE INVENTION

When the scraper of the present invention is assembled in the non-rotating configuration, a shear ring is installed in the bottom sub to prevent the clutch between the scraper blade sleeve and the bottom sub from engaging. If the blades become stuck because of debris or damaged casing, the drill string can be pulled upward to release the shear ring. Once the shear ring is pushed down into a cavity in the bottom sub, the clutch between the bottom sub and the scraper blade sleeve will engage. The scraper blades can then be rotated to help free the stuck scraper.

If the shear ring is installed above the scraper blade sleeve, the clutch between the bottom sub and the scraper blade sleeve will be engaged during assembly of the scraper. The scraper blades will then rotate when the drill string is rotated.

The scraper blades are retained in the scraper blade sleeve by T-shaped plates, a retaining ring, and dowel pins. No threads or fasteners are used that could vibrate loose during operation of the scraper.

A non-rotating cylindrical brush can be installed above the scraper blade sleeve when the scraper is assembled in the rotating or non-rotating configuration. The cylindrical brush has a large enough pitch so that wellbore fluid can be circulated around the brush elements.

Figure 1:
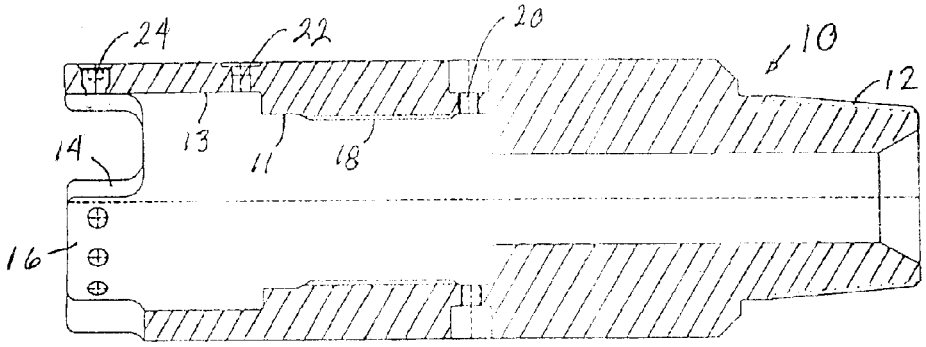
FIG. 1 is a longitudinal section view of a bottom sub of the apparatus of the present invention.

As shown in FIG. 1, a bottom sub 10 included in the present invention is a hollow cylindrical sub having a threaded lower end 12, and a hollow bore including a mandrel bore 11, female threads 18 for attaching to a mandrel, and a shear ring cavity 13 near its upper end. At the upper end of the bottom sub 10 is a clutch profile consisting of a plurality of notches 14 alternating with a plurality of dogs 16. At least one set screw hole 20 is provided through the wall of the bottom sub 10 into the mandrel bore 11, below the female threads 18. At least one grease fitting hole 22 is provided through the wall of the bottom sub 10 into the shear ring cavity 13, preferably near the bottom end of the shear ring cavity 13. A plurality of shear screw holes 24 are provided through the wall of the bottom sub 10 into the top portion of the shear ring cavity 13, preferably through the clutch dogs 16.

Figure 2:
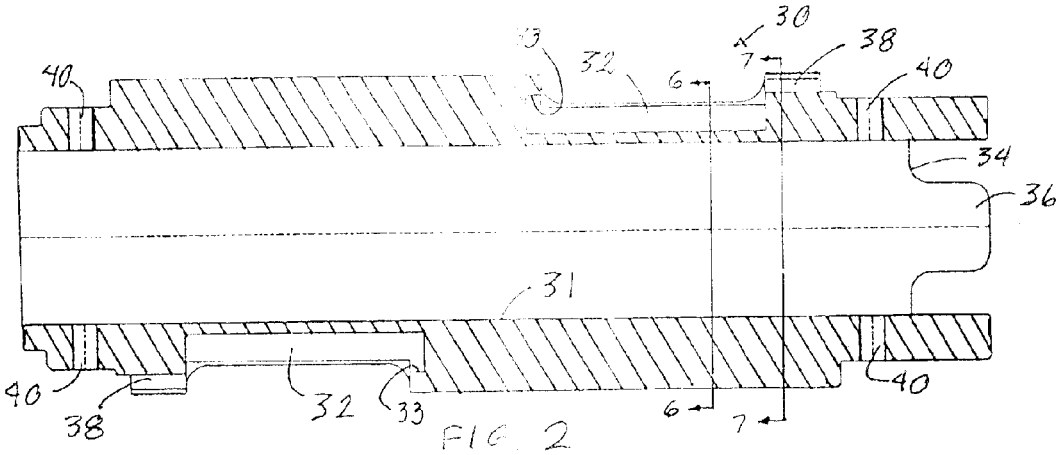
FIG. 2 is a longitudinal section view of a scraper blade sleeve of the apparatus of the present invention.
Figure 3:
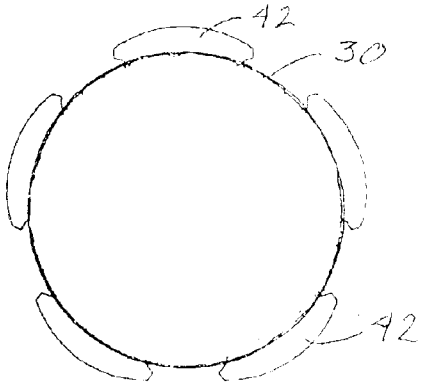
FIG. 3 is an outline view of the end of the scraper blade sleeve shown in FIG. 2, demonstrating one embodiment of scraper blade locations.
Figure 6:
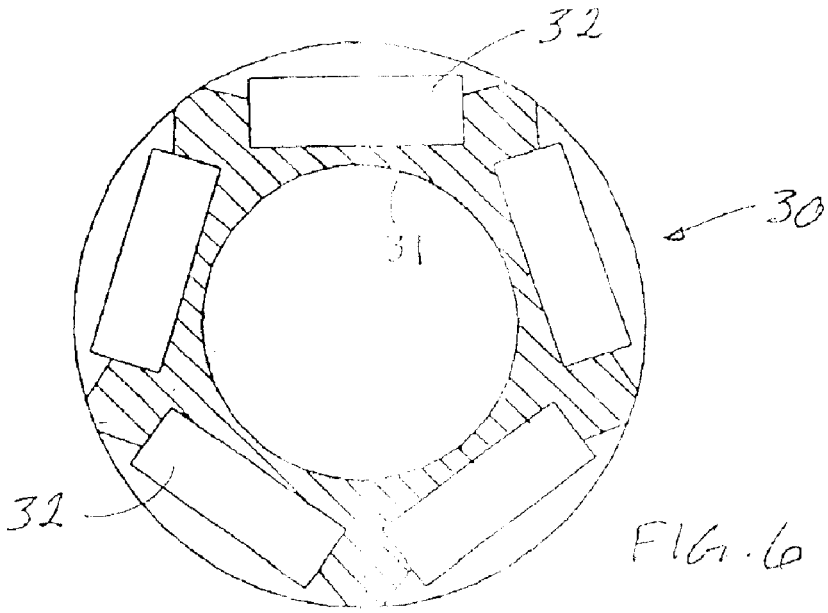
FIG. 6 is a transverse section view of the scraper blade sleeve shown in FIG. 2, taken at the line 6—6.

As shown in FIG. 2, also included in the present invention is a hollow cylindrical scraper blade sleeve 30, with a hollow mandrel bore 31. At least two circumferentially arranged sets of scraper blade receptacles 32 are provided in the wall of the scraper blade sleeve 30. FIG. 6 shows a transverse section view of the scraper blade sleeve 30, illustrating one embodiment of the arrangement of the scraper blade receptacles 32 in one of the sets of receptacles 32. One of the sets of scraper blade receptacles 32 is positioned above the other set of scraper blade receptacles 32, and the receptacles 32 in these two sets are staggered relative to each other, in overlapping fashion, to insure full coverage of the circumference of the casing as the scraper is run axially through the casing.

Figure 4:
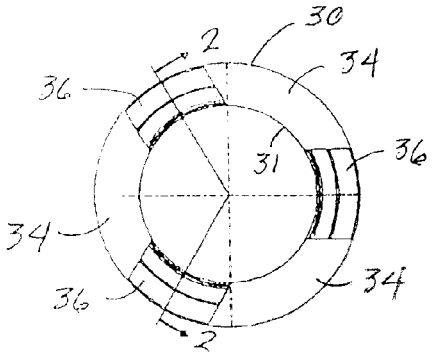
FIG. 4 is an end view of the scraper blade sleeve shown in FIG. 2.

At the lower end of the scraper blade sleeve 30 is a clutch profile consisting of a plurality of notches 34 alternating with a plurality of dogs 36. FIG. 4 shows an end view of the scraper blade sleeve 30, to illustrate one embodiment of the arrangement of the notches 34 and dogs 36. The notches 34 and dogs 36 of the clutch profile on the lower end of the scraper blade sleeve 30 are shaped and sized to mate with the dogs 16 and notches 14, respectively, of the clutch profile on the upper end of the bottom sub 10.

Figure 7:
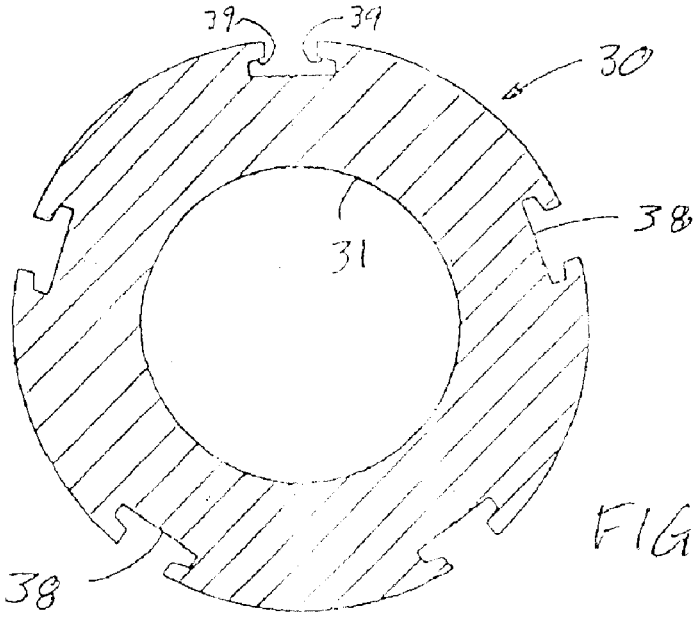
FIG. 7 is a transverse section view of the scraper blade sleeve shown in FIG. 2, taken at the line 7—7.

At one end of each scraper blade receptacle 32, an undercut 33 is provided, to retain a lip on one end of the associated scraper blade. Next to each scraper blade receptacle 32, a longitudinal blade keeper slot 38 is provided, having undercut sides 39 for retaining a T-shaped blade keeper 44. FIG. 7 shows a transverse section view of the arrangement and the undercut sides 39 of the blade keeper slots 38 adjacent to one set of the scraper blade receptacles 32.

Figures 5A, 5B, 5C:
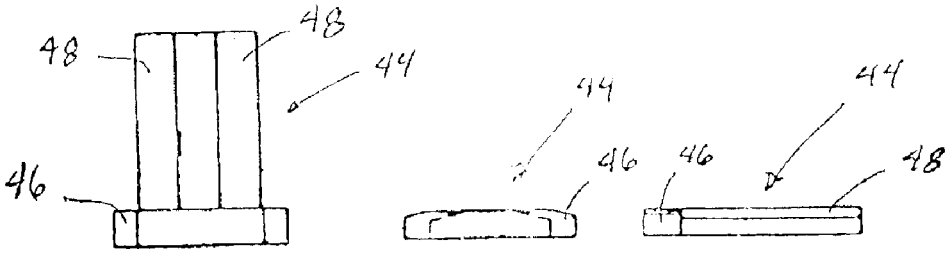
FIGS. 5A, 5B, and 5C are top, end and side elevation views, respectively, of a T-shaped blade keeper as used in the present invention.

FIGS. 5A, 5B, and 5C show top, end, and side elevation views, respectively, of a T-shaped blade keeper plate 44 as used in the present invention. The blade keeper 44 has a head 46 of greater width than the width of its body. The body has two beveled sides 48. The head 46 can also have beveled sides as shown. It can be seen that the T-shaped keeper 44 can slide into one of the blade keeper slots 38 in the scraper blade sleeve 30, with the beveled sides 48 on the blade keeper body sliding underneath the undercut sides 39 of the blade keeper slot 38. The length of the blade keeper body is greater than the length of the blade keeper slot 38, so that the end of the blade keeper body projects partially over one end of the adjacent scraper blade receptacle 32.

Figure 8:
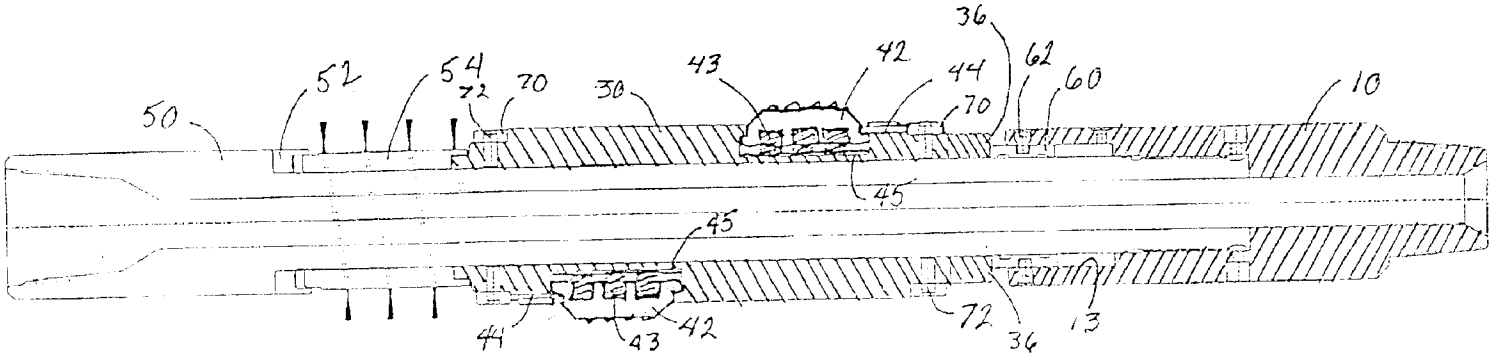
FIG. 8 is a longitudinal section view of the apparatus of the present invention, assembled in the non-rotating configuration.

Before running into a casing, the tool can be assembled as shown in FIG. 8, in what is referred to as the non-rotating configuration. Here, the scraper blade sleeve 30 and the bottom sub 10 are assembled onto a mandrel 50, with a free rotating brush 54 arranged on the mandrel 50 above the free rotating scraper blade sleeve 30. The lower end of the brush 54 can overlap the upper end of the scraper blade sleeve 30, and a wear ring 52 on the mandrel 50 above the brush 54 can overlap the upper end of the brush 54.

A retainer ring 70 is positioned around the circumference of the scraper blade sleeve 30 adjacent to the heads of each set of the T-shaped blade keepers 44, to hold the T-shaped blade keepers 44 in the blade keeper slots 38. Each retainer ring 70 is held in place by a plurality of dowel pins 72, which are inserted through the dowel pin holes 40, from the inner bore of the scraper blade sleeve 30. Each blade keeper 44 extends over a lip on one end of the adjacent scraper blade 42, while a similar lip on the other end of each scraper blade 42 is captured under an undercut 33 in the scraper blade receptacle 32.

A plurality of compression springs 43 beneath each scraper blade 42 push the blade 42 outwardly, to maintain forceful scraping contact between the blade 42 and the inner surface of the casing (not shown). This outward force on the blades 42 also maintains centralization of the apparatus in a slanted or horizontal well bore, to insure cleaning of the full inner surface of the casing, even on the high side. When the tool is used in a lightweight casing with a slightly larger ID, a shim 45 can be provided under the blade 42 to limit inward blade travel, thereby ensuring centering of the tool.

The mandrel 50 is free to rotate relative to the scraper blade sleeve 30 and relative to the brush 54, but the bottom sub 10 rotates with the mandrel 50, since the mandrel 50 is threaded to the threads 18 in the mandrel bore 11 of the bottom sub 10. In other words, torque applied to the mandrel 50 by a drill string (not shown) will be transferred to the bottom sub 10, but not to the scraper blade sleeve 30. The attachment of the bottom sub 10 to the mandrel 50 can be augmented by set screws installed through the set screw holes 20.

A shear ring 60 is positioned around the mandrel 50, near the upper end of the bottom sub 10, within the shear ring cavity 13. The shear ring 60 is held in this position by a plurality of shear screws 62 through the shear screw holes 24 in the clutch dogs 16. The shear ring 60 abuts the lower ends of the clutch dogs 36 on the lower end of the scraper blade sleeve 30 and prevents the clutch dogs 36 from mating with the clutch notches 14 on the upper end of the bottom sub 10. This ensures that torque is not transferred to the scraper blade sleeve 30, when the mandrel 50 is rotated by the drill string (not shown); therefore, this configuration of the apparatus is referred to as the non-rotating configuration. The lower portion of the shear ring cavity 13 below the shear ring 60 can be filled with grease through the grease fitting hole 22, to keep debris out of the lower portion of the cavity 13.

If the tool is run into the hole in the configuration shown in FIG. 8, and then the scraper blade sleeve 30 becomes stuck in the casing, it may be desirable to convert the tool from the non-rotating configuration to a rotating configuration, enabling transfer of torque from the bottom sub 10 to the scraper blade sleeve 30, to aid in working the tool free. This can be done by pulling up on the drill string, which will pull up on the bottom sub 10 and force the shear ring 60 against the lower ends of the clutch dogs 36 on the lower end of the scraper blade sleeve 30, until the shear screws 62 are sheared. This allows the shear ring 60 to be forced into the lower portion of the shear ring cavity 13 by the clutch dogs 36 on the scraper blade sleeve 30. The grease below the shear ring 60 can be forced out of the shear ring cavity 13 by the shear ring 60. As the clutch dogs 36 force the shear ring 60 downwardly, the clutch dogs 36 and clutch notches 34 on the lower end of the scraper blade sleeve 30 mate with the clutch notches 14 and clutch dogs 16, respectively, on the upper end of the bottom sub 10. This configures the bottom sub 10 and the scraper blade sleeve 30 in a driving torque transfer relationship, so that as the drill string rotates the mandrel 50 and the bottom sub 10, the bottom sub 10 will rotate the scraper blade sleeve 30, to assist in working the tool free.

Once the tool has been thusly "converted" from the non-rotating configuration to the rotating configuration, putting weight on the tool by slacking off on the drill string will disengage the clutch mechanism, because of the drag provided by the blades 42. This temporarily converts the tool back to the non-rotating configuration, as long as upward force is not exerted on the bottom sub. If the drill string is again lifted, the clutch will re-engage.

Figure 9:
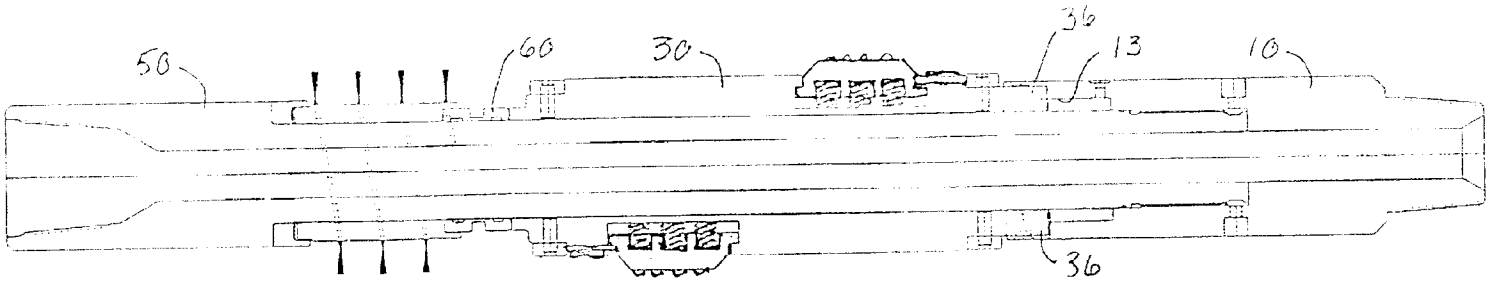
FIG. 9 is a longitudinal section view of the apparatus of the present invention, assembled in the rotating configuration.

The tool can also be assembled in the configuration shown in FIG. 9, which is referred to as the rotating configuration, before running the tool into the casing. As seen, the shear ring 60 has been re-located from the shear ring cavity 13 to a location above the scraper blade sleeve 30. As shown, this causes the clutch notches 34 and clutch dogs 36 on the lower end of the scraper blade sleeve 30 to mate with the clutch dogs 16 and clutch notches 14, respectively, on the upper end of the bottom sub 10, in a torque transfer driving relationship. The shear screws 62 can be left stored in the shear screw holes 24, without interfering with the operation of the scraper. In this configuration, similar to the "converted" configuration discussed above, as the drill string rotates the mandrel 50, the mandrel 50 rotates the scraper blade sleeve 30, because of the engagement of the clutch mechanism on the upper end of the bottom sub 10 and on the lower end of the scraper blade sleeve 30, transferring torque from the bottom sub 10 to the scraper blade sleeve 30.

It can be seen by comparing FIGS. 8 and 9 that a small gap is necessary between the wear ring 52 and the brush 54, to allow sufficient room for the width of the shear ring 60 above the scraper blade sleeve 30, when the tool is assembled in the rotating configuration of FIG. 9. This is because, when the tool is assembled in the non-rotating configuration of FIG. 8, the shear ring 60 must be wider than the distance between the bottom of the upper clutch dogs 36 and the bottom of the lower clutch notches 14, to keep excess debris out of the shear ring cavity 13.

While the particular invention as herein shown and disclosed in detail is fully capable of obtaining the objects and providing the advantages herein before stated, it is to be understood that this disclosure is merely illustrative of the presently preferred embodiments of the invention and that no limitations are intended other than as described in the appended claims.

We claim:

1. A tubular scraper tool, comprising:

a mandrel;

a scraper blade sleeve mounted on said mandrel in a non-torque-transfer relationship;

at least one scraper blade mounted on said scraper blade sleeve, said at least one scraper blade being adapted for longitudinal tubular scraping;

a sub fixedly mounted to said mandrel, adjacent said scraper blade sleeve;

a clutch mechanism adapted to selectively engage said scraper blade sleeve with said sub in a torque transfer relationship;

a non-threaded capture mechanism on said scraper blade sleeve, said capture mechanism being adapted to capture said at least one scraper blade to said scraper blade sleeve;

wherein said capture mechanism comprises:

a longitudinal slot adjacent each said scraper blade on said scraper blade sleeve;

a keeper plate longitudinally slidable into said longitudinal slot, said keeper plate being adapted to extend at least partially over said scraper blade;

an undercut in said slot adapted to prevent said keeper plate from escaping radially from said slot;

a retainer ring disposable around said scraper blade sleeve adjacent to said longitudinal slot to prevent said keeper plate from sliding longitudinally out of said slot; and a dowel pin inserted from within said scraper blade sleeve to secure said retainer ring longitudinally in place on said scraper blade sleeve.

2. A tubular scraper tool, comprising:

a mandrel;

a scraper blade sleeve mounted on said mandrel in a non-torque-transfer relationship;

at least one scraper blade mounted on said scraper blade sleeve, said at least one scraper blade being adapted for longitudinal tubular scraping;

a sub fixedly mounted to said mandrel, adjacent said scraper blade sleeve;

a clutch mechanism adapted to selectively engage said scraper blade sleeve with said sub in a torque transfer relationship; and a convertible positioning mechanism adapted to be selectively mountable in a first alternative configuration to prevent engagement of said clutch mechanism, said positioning mechanism being adapted to shear upon application of a selected longitudinal force to said sub by said mandrel, to thereby allow engagement of said clutch mechanism.

3. The tool recited in claim 2, wherein said positioning mechanism is adapted to be mounted in said first configuration to prevent relative longitudinal movement between said sub and said scraper blade sleeve before being sheared and adapted to allow relative longitudinal movement between said sub and said scraper blade sleeve after being sheared, thereby allowing selective engagement of said clutch mechanism.

4. The tool recited in claim 3, wherein said positioning mechanism comprises a ring selectively mountable in an abutting relationship with one of said scraper blade sleeve and said sub, said ring being shearably retained against longitudinal movement relative to the other of said scraper blade sleeve and said sub.

5. The tool recited in claim 4, further comprising a shear ring cavity on said other of said scraper blade sleeve and said sub for receiving said ring after said ring is sheared free, said shear ring cavity being positioned to receive said ring as said sub moves longitudinally relative to said scraper blade sleeve.

6. The tool recited in claim 4, wherein said shear mechanism further comprises at least one shear pin shearably retaining said ring against said longitudinal movement relative to said other of said scraper blade sleeve and said sub.

7. The tool recited in claim 2, wherein said convertible positioning mechanism is further adapted to be selectively mountable in a second alternative configuration to position said scraper blade sleeve relative to said sub to engage said clutch mechanism.

* * * * *